United States Patent [19]

Niina

[11] Patent Number: 4,726,311

[45] Date of Patent: Feb. 23, 1988

[54] UNIT FOR SUPPORTING HANDLE OF WATERCRAFT

[75] Inventor: Jiro Niina, Kobe, Japan

[73] Assignee: Kawasaki Jukogyo Kabushiki Kaisha, Kobe, Japan

[21] Appl. No.: 847,249

[22] Filed: Apr. 2, 1986

[30] Foreign Application Priority Data

Apr. 3, 1985 [JP] Japan ..... 70516/85

[51] Int. Cl.[4] ..... B63H 25/02

[52] U.S. Cl. ..... 114/144 R; 74/493; 114/270

[58] Field of Search ..... 114/270, 144 R, 150; 74/493; 441/65, 72, 73; 280/16

[56] References Cited

U.S. PATENT DOCUMENTS

| | | | |
|---|---|---|---|
| 756,670 | 4/1904 | Marr | 74/493 |
| 1,785,783 | 12/1930 | Mohr | 280/16 |
| 2,826,090 | 3/1958 | Grinnell et al. | 74/493 |
| 3,092,857 | 6/1963 | Churchman | 441/65 |
| 3,168,156 | 2/1965 | Ulinski | 74/493 X |
| 3,395,930 | 8/1968 | Morgan | 74/493 X |
| 3,487,712 | 1/1970 | Steiner | 74/493 |
| 3,559,611 | 2/1971 | Cushman | 114/270 |
| 4,481,838 | 11/1984 | Findley et al. | 74/493 |

FOREIGN PATENT DOCUMENTS

| | | |
|---|---|---|
| 348872 | 2/1922 | Fed. Rep. of Germany . |
| 449793 | 2/1952 | Japan . |
| 1291904 | 10/1972 | United Kingdom . |
| 1445372 | 8/1976 | United Kingdom . |
| 1483978 | 8/1977 | United Kingdom . |

*Primary Examiner*—Sherman D. Basinger
*Attorney, Agent, or Firm*—Leydig, Voit & Mayer

[57] ABSTRACT

The present invention provides a tiltable steering handle unit which can be manually unlocked to adjust its angular position and then automatically locked at a selected angular position, whereby an operator can choose an optimum attitude of the steering unit depending on his physical features or preferences.

6 Claims, 5 Drawing Figures

UNIT FOR SUPPORTING HANDLE OF WATERCRAFT

BACKGROUND OF THE INVENTION

The present invention relates to a small-sized watercraft having a seat on the rearward position of the hull and a steering handle disposed on the hull forwardly of the seat and particularly to a unit for supporting the steering handle.

In such a watercraft, an operator may take the seat and manipulate the steering handle to operate or drive the watercraft.

One of such types of watercrafts is disclosed, for example, in Japanese Pat. No. Des. 449,793. However, the watercraft includes a steering handle which is not tiltable for an operator to take an attitude compatible with his physical features or preferences.

SUMMARY OF THE INVENTION

It is therefore an object of the present invention to provide a small-sized watercraft including a steering handle which is tiltable for an operator to take an optimum attitude depending on his physical features or preferences.

To this end, the present invention provides a small-sized watercraft comprising a seat on the rearward portion of the hull; a mounting wall disposed in the hull forwardly of said seat; a steering column rigidly mounted on said mounting wall; a steering shaft rotatably supported in said steering column; a tiltable member supported on the steering shaft and carrying a steering handle, said tiltable member being angularly adjustable in a fore-and-aft direction about a pivot shaft; manually operable positioning means disposed between said tiltable member and said steering shaft for locking said tiltable member at a selected angular attitude.

In such an arrangement, the positioning means is unlocked by the use of the manually unlocking means to adjust the angular position of the tiltable member with the steering handle in the fore-and-aft direction. Subsequently, the tiltable member can automatically be locked in its desired angular position.

DESCRIPTION OF THE PREFERRED EMBODIMENTS

Figure 1:
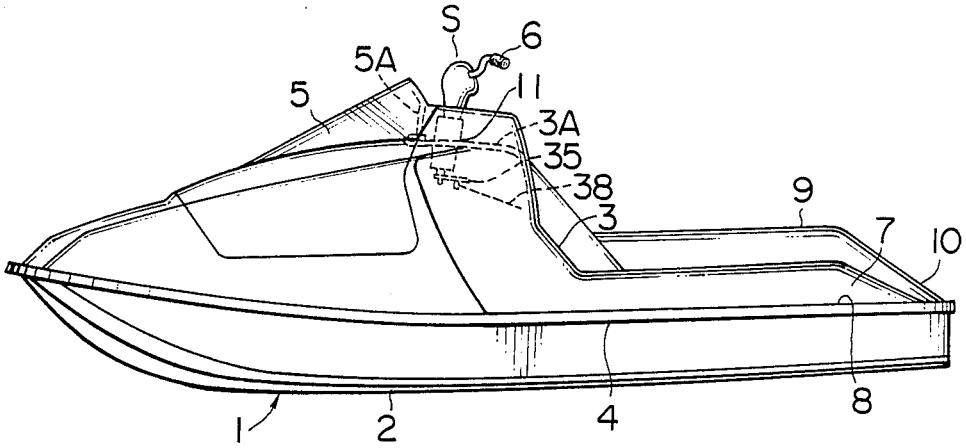
FIG. 1 is a left-hand side view of a small-sized watercraft incorporating a tiltable steering handle which is one embodiment of the present invention.

Referring now to FIG. 1, there is shown a watercraft having a hull 1 which comprises a lower hull portion 2 and an upper deck portion 3. The lower and upper portions 2 and 3 are made of a fiber reinforced plastic (FRP) and sealingly joined with each other at their peripheral flanges 4.

The deck portion 3 extends from the bow of the hull to the stern of the same and an openable hood 5 provided on the forward portion of the deck to cover an engine (not shown) which is mounted within the hull 1. Behind the hood 5 is an upright wall, shown by broken line 5A in FIG. 1, which has its lower end sealingly mounted on a mounting wall 3A formed integrally with a top wall facing the rearward portion of the hood 5. A steering unit S is mounted in the mounting wall 3A.

Figure 2:
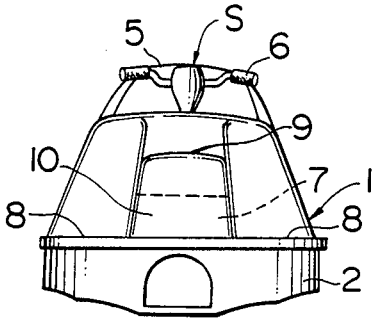
FIG. 2 is a back elevational view of the watercraft shown in FIG. 1.

The portion of the deck 3 extending rearwardly from the steering unit S is formed integrally with a seat mount 7 having a central raised part and foot rests 8 located on the opposite sides of the seat mount 7 at a lowered level, as best seen from FIG. 2.

As seen from FIG. 1, a seat 9 is rigidly supported on the top of the seat mount 7. The rearward portion of the seat 9 extends rearwardly and downwardly to form a riding slope 10.

Figure 4:
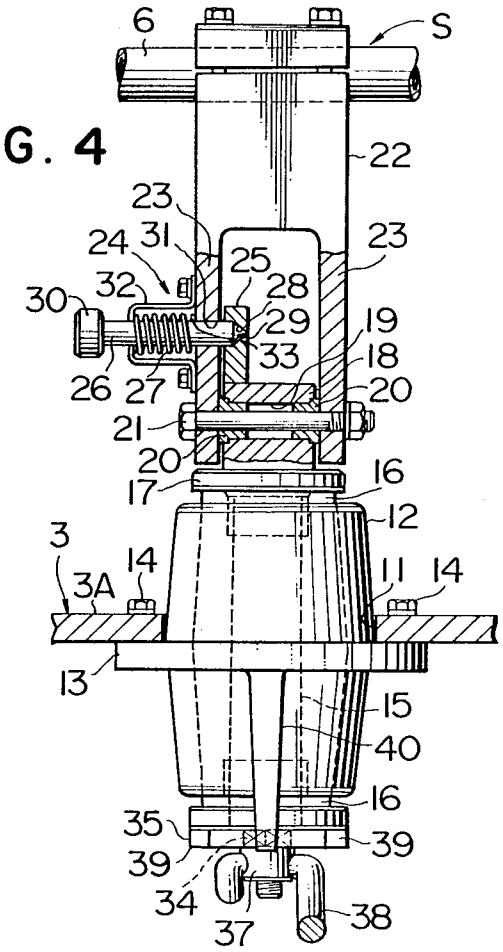
FIG. 4 is a back elevational view of the unit shown in FIG. 3.
Figure 3:
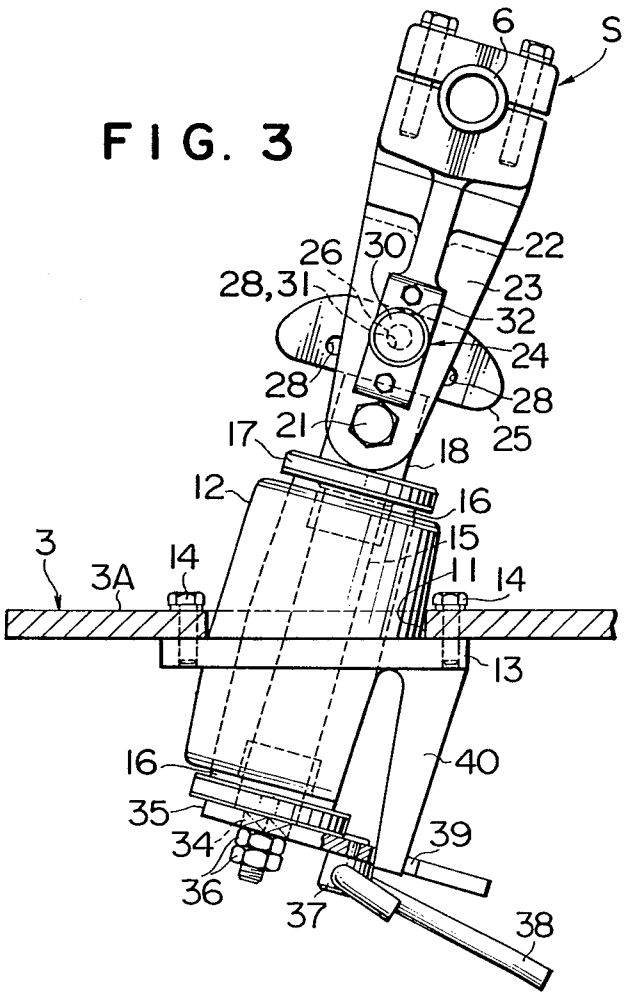
FIG. 3 is an enlarged cross-sectional view of the primary parts of a unit for supporting the tiltable steering handle.

Referring next to FIGS. 3 and 4, the steering unit S comprises a steering column 12 extending through an opening 11 in the mounting wall 3A. The steering column 12 is of a hollow cylinder configuration and includes an outwardly extending flange 13 formed integrally thereon about the outer periphery thereof. The steering column 12 is inserted upwardly into the opening 11 of the mounting wall 3A and then the flange 13 thereof is applied and attached to the bottom face of the mounting wall 3A by means of any suitable fastening means such as bolts 14.

The flange 13 is positioned on the steering column 12 at a central position between the opposite ends thereof. Thus, the steering column 12 will have its upwardly and downwardly extending portions of substantially the same length about the mounting wall 3A.

Prior to the mounting of the steering column 12 on the mounting wall 3A, a steering shaft 15 is passed through the hollow portion of the steering column 12. The steering shaft 15 is rotatably supported within flanged bearing bushings 16 which are disposed within the upper and lower ends of the hollow steering column 12, respectively.

The steering shaft 15 has a support flange 17 formed thereon at a position adjacent to the upper bearing bushing 16 and a cylinder-shaped support boss 18 upwardly extending from the support flange 17. As seen from FIG. 4, the support boss 18 includes a transverse bore 19 formed therein within which flanged pivot bushings 20 are rigidly supported at the opposite ends of the bore 19. Pivot shaft means (bolt-nut means) 21 extends through the transverse bore 19 of the support boss 18 and is rotatably supported by the pivot bushings 20 therein. The pivot shaft means 21 supports a tiltable member 22 which is preferably of aluminium and which can angularly be positioned about the pivot shaft means 21 in a fore-and-aft direction relative to the hull. The top of the tiltable member 22 detachably supports a bar-like steering handle 6.

The flange on each of the pivot bushings 20 is disposed outwardly of the bore 19 in the support boss 18, the outer face of each flange being engaged by the inner face of each of a pair of legs 23 formed on the bifurcated tiltable member 22. The lower ends of the legs 23 of the bifurcated tiltable member 22 are curved to allow the tiltable member to pivot while maintaining a substantially constant clearance (as shown in FIG. 4) between the curved ends of the legs and the steering column assembly.

The tiltable member 22 can be locked at a chosen angular position by positioning means 24 which comprises a positioning stopper 25, a positioning pin 26 and a set spring 27.

As seen from FIGS. 3 and 4, the positioning stopper 25 is a plate-shaped member which upwardly extends from and is welded to the top face of the support boss 18 at one side. As best seen from FIG. 3, the positioning stopper 25 includes a plurality of tapered positioning apertures 28 (three in the illustrated embodiment) which are located on a circle having a center on the pivot shaft 21. In the illustrated embodiment, the central one of the tapered positioning apertures 28 serves to position the tiltable member 22 at its neutral location and the remaining apertures 28 are used to position the tiltable member 22 at its forwardly and rearwardly tilted locations, respectively.

As best seen from FIG. 4, the positioning pin 26 includes an inner tapered end 29 adapted to penetrate into one of the tapered positioning apertures 28 in the positioning stopper 25 and an outer unlocking end 30 manually operated by an operator. The positioning pin 26 movably passes through a pin aperture 31 formed in the tiltable member 22.

The set spring 27 is located within a spring receiver 32 which is mounted on the tiltable member 22 at one side and outwardly extends therefrom. The set spring 27 has one end engaged by the outer end of the spring receiver 32 and the other end seated on an intermediate flange 33 on the positioning pin 26. Thus, the positioning pin 26 is resiliently biased against the stopper 25 under the action of the set spring 27 such that the inner end 29 of the positioning pin 26 can positively be held in one of the positioning apertures 28 in the positioning stopper 25.

As best seen from FIG. 3, the steering shaft 15 downwardly extends beyond the lower end of the steering column 12 which is located downwardly of the mounting wall 3A. The downwardly extending portion of the steering shaft 15 includes a square-shaped boss 34 which is fitted into the corresponding opening of a rotatable plate-shaped steering force transmitting member 35. A lock nut 36 is threadingly engaged onto the lowermost threaded end of the steering shaft 15 and then tightened against the rotatable member 35 such that the latter can be rotated with the steering shaft 15.

The rotatable member 35 includes a rotary piece 37 extending downwardly from the bottom thereof, which piece 37 is connected with one end of a steering force transmitting relay member 38 in the form of a cable for converting a rotational movement into a linear movement. As best seen from FIG. 4, the rotatable steering force transmitting member 35 includes two engagement lugs 39 spaced away from each other about the outer periphery of the member 35. Between these engagement lugs 39 is received a stopper 40 which extends downwardly from the mounting flange 13 of the steering column 12. Thus, the rotation of the rotatable member 34 and thus the steering handle 6 can be limited by engagement of the engagement lugs 39 with the stopper 40. The other end of the relay member 38 may be connected with steering nozzle means (not shown) on the stern of the hull and used to change the direction of the moving watercraft.

In such an arrangement, when the position of the tiltable member 22 is to be angularly adjusted, the outer unlocking end 30 of the positioning pin 26 is manually pulled out against the action of the set spring 27 to disengage the inner end 29 of the positioning pin 26 from the positioning aperture 28. After the angular position of the tiltable member 22 has been adjusted, the positioning pin 26 is simply released to penetrate its inner end 29 into a selected one of the positioning apertures 28 under the action of the set spring 27, so that the tiltable member 22 and thus the steering handle 6 can automatically be locked at the desired angular position. In such a manner, the operator can take an optimum attitude for the steering handle 6, depending on his physical features or preferences.

Figure 5:
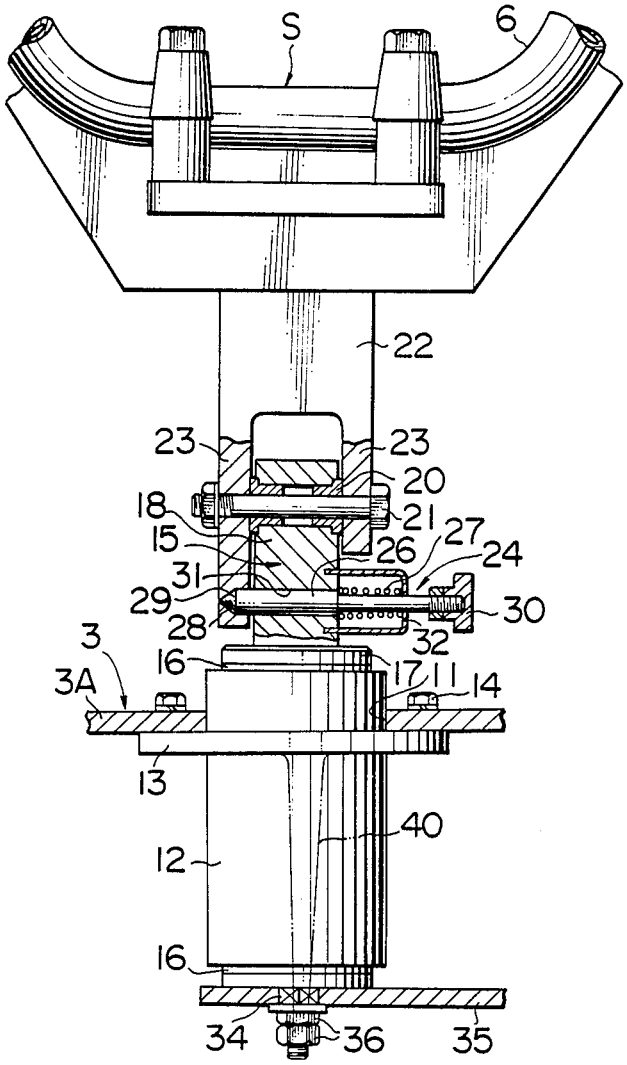
FIG. 5 is a front elevational view of a modification of the unit for supporting the tiltable steering handle.

Referring next to FIG. 5, there is shown a modification of the embodiment shown in FIGS. 1 to 4, in which the pivot shaft 21 is disposed above the positioning means 24. In such a modification, the steering handle 6 can less be moved to provide the same amount of tilt. This leads to a reduced size in the tiltable steering unit. Although the structure shown in FIG. 4 includes the positioning pin 26 on the tiltable member 22 and the positioning apertures 28 in the steering shaft 15, the positioning pin 26 and positioning apertures 28 may be provided respectively on the steering shaft 15 and tiltable member 22, as shown in FIG. 5.

As will be apparent from the foregoing, the present invention provides a tiltable steering unit which can be angularly adjusted depending on the operator's physical features or preferences by manually unlocking the positioning means to adjust the steering handle into a desired angular position and thereafter automatically locking the steering handle at that desired angular position.

I claim:

1. A watercraft having a substantially vertical steering handl supporting unit, said watercraft comprising:

a hull, a seat on the rearward portion of said hull, and a mounting wall disposed in said hull forwardly of said seat, said steering handle supporting unit comprising a steering column assembly rigidly mounted in said mounting wall, a steering shaft having a support boss extending from an uppermost end portion thereof, said steering shaft and said support boss being rotatably supported in said steering column assembly, a tiltable member carrying a steering handle and having a bifurcated lower end portion providing legs straddling said support boss and mounted thereon, a pivot shaft extending through said legs and support boss for pivotably mounting and angularly positioning said tiltable member with a selected angular attitude in a fore-and-aft direction of said hull, said legs of said bifurcated lower end portion of said tiltable member having curved ends to allow said tiltable member to pivot while maintaining a substantially constant clearance between said curved ends of said legs and said steering column assembly, and manually operable positioning means including a positioning stopper having a plurality of tapered positioning apertures, a spring receiver, a positioning pin inserted through said receiver and having a flange disposed intermediately thereon, and a set spring abutting and cooperating with said receiver and said flange to bias a tapered end of said positioning pin into engagement with said tapered positioning apertures to lock said tiltable member at the selected angular attitude, said positioning means being disposed below said pivot shaft and above said column;

said spring receiver, said positioning pin and said set spring being mounted on said steering shaft.

2. A watercraft having a steering handle supporting unit as defined in claim 1 wherein said positioning pin is located on said steering shaft.

3. A watercraft having a substantially vertical steering handle supporting unit, said watercraft comprising:

a hull, a seat on the rearward portion of said hull, and a mounting wall disposed in said hull forwardly of said seat, said steering handle supporting unit comprising a steering column assembly rigidly mounted in said mounting wall, a steering shaft having a support boss extending from an uppermost end portion thereof, said steering shaft and said support boss being rotatably supported in said steering column assembly, a tiltable member carrying a steering handle and having a bifurcated lower end portion providing legs straddling said support boss and mounted thereon, a pivot shaft extending through said legs and support boss for pivotably mounting said tiltable member and angularly positioning with a selected angular attitude in a fore-and-aft direction of said hull, said legs of said bifurcated lower end portion of said tiltable member having curved ends to allow said tiltable member to pivot while maintaining a substantially constant clearance between said curved ends of said legs and said steering column assembly, and manually operable positioning means including a positioning stopper provided on said tiltable member and having a plurality of tapered positioning apertures, a spring receiver, a positioning pin inserted through said receiver and having a flange disposed intermediately thereon, and a set spring abutting and cooperating with said receiver and said flange to bias a tapered end of said positioning pin into engagement with said tapered positioning apertures to lock said tiltable member at the selected angular attitude, said positioning means being disposed below said pivot shaft and above said column;

said spring receiver, said positioning pin and said set spring being mounted on said steering shaft.

4. A watercraft having a substantially vertical steering handle supporting unit, said watercraft comprising:

a hull, a seat on the rearward portion of said hull, and a mounting wall disposed in said hull forwardly of said seat, said unit comprising a steering column assembly rigidly mounted in said mounting wall, a rotatable steering shaft having a support boss extending from an uppermost end portion of said steering shaft, said support boss being rotatably supported in said steering column assembly, a tiltable member carrying a steering handle and mounted on said support boss, means coupling said tiltable member and said support boss to transmit sideways movement of the steering handle to rotate said steering shaft including a bifurcated lower end portion of said tiltable member providing legs straddling said support boss and mounted thereon and a pivot shaft extending through said legs and support boss pivotably mounting said tiltable member such that it stands with a selected angular attitude in a fore-and-aft direction of said hull and coupling said tiltable member to said support boss, and manually operable positioning means including a positioning stopper having a plurality of tapered positioning apertures, a spring receiver, a positioning pin inserted through said receiver and having a flange disposed intermediately thereon, and a set spring abutting and cooperating with said receiver and said flange to bias a tapered end of said positioning pin into engagement with said tapered positioning apertures to lock said tiltable member at the selected angular attitude, said positioning means being vertically disposed below said pivot shaft and above said column;

said spring receiver, positioning pin and set spring being mounted on said steering shaft.

5. A watercraft having a steering handle supporting unit as defined in claim 4 wherein said positioning stopper is provided on said tiltable member.

6. A watercraft having a steering handle supporting unit as defined in claim 4 including pivot bushings between said legs and said support boss and providing a rotatable support for said pivot shaft.

* * * * *